US006145835A

United States Patent [19]

Such

[11] Patent Number: 6,145,835

[45] Date of Patent: Nov. 14, 2000

[54] METHOD AND KIT FOR A CONSTANT VALUE JACKPOT GAME OF CHANCE

[75] Inventor: David A. Such, Great Falls, Mont.

[73] Assignee: D. Allan Such & Associates, Inc., Great Falls, Mont.

[21] Appl. No.: 09/198,991

[22] Filed: Nov. 23, 1998

Related U.S. Application Data

[60] Provisional application No. 60/067,053, Dec. 1, 1997.

[51] Int. Cl.[7] ..... A63B 71/00; A63F 1/18

[52] U.S. Cl. ..... 273/139

[58] Field of Search ..... 273/139

[56] References Cited

U.S. PATENT DOCUMENTS

| | | | |
|---|---|---|---|
| 3,900,219 | 8/1975 | D'Amato et al. | 273/139 |
| 4,740,016 | 4/1988 | Konecny et al. | 273/139 |
| 5,046,737 | 9/1991 | Fienberg | 273/139 |

OTHER PUBLICATIONS

Douglas Press, Inc., 1987.

Bazaar & Novelty 1995–1996 (pp. 97–109), Oct. 1995.

*Primary Examiner*—Jessica J. Harrison

*Assistant Examiner*—Dolores Collins

*Attorney, Agent, or Firm*—Webb Ziesenheim Logsdon Orkin & Hanson, P.C.

[57] ABSTRACT

A method of conducting a lottery game by a master game sponsor comprises the steps of producing a plurality of lottery ticket game sets making up one master game, the games sets comprising a plurality of lottery tickets with hidden indicia, the tickets having a tab that can be torn free to reveal the hidden indicia setting forth that some of the tickets entitle the purchaser to instant winnings and/or eligibility for a constant value jackpot associated with the master game, selling game sets from a single master game to vendors who may in turn sell the individual lottery tickets from the game sets, and receiving jackpot tickets and randomly selecting a jackpot winner from those jackpot tickets received and distributing the jackpot prize to the jackpot winner.

5 Claims, 2 Drawing Sheets

METHOD AND KIT FOR A CONSTANT VALUE JACKPOT GAME OF CHANCE

RELATED APPLICATION

This application claims the benefit of U.S. Provisional Patent Application Ser. No. 60/067,053, filed Dec. 1, 1997.

BACKGROUND OF THE INVENTION

This invention is directed to a game of chance kit and, more particularly, to a game kit for use by charitable organizations, clubs and taverns and the like whereby members or customers can purchase a ticket and instantly win a prize if the ticket is a "winner". These kits are sold through licensed distributors in states where such games are legal. Typically, the kit is purchased by the charitable organization, club or tavern, the tickets are sold and the instant prizes are paid by the kit purchaser. The number of winners is precisely controlled so that the income from ticket sales will exceed the total cost of the instant prizes and so that the ticket purchasers will know in advance the payout if all tickets are purchased.

Game kits have been designed which give the impression of additional levels of play. See, for example, U.S. Pat. No. 5,046,737. However, the additional levels of play permitting the customer to win a bonus or sweepstakes prize require the bonus or sweepstakes to be funded entirely by the charitable organization, club or tavern selling the sweepstakes winning ticket.

SUMMARY OF THE INVENTION

Briefly, according to this invention, there is provided a lottery game kit comprising a container for a set of game tickets of a preselected number which tickets can be purchased by game players. Each ticket has concealed indicia (symbols or numbers), some of which indicate entitlement to an instant prize and/or eligibility for a constant value jackpot. Each ticket contains indicia of a particular game set and indicia of a master game. A game set comprises all tickets in one container including both winners and losers and possibly one ticket indicating eligibility for the constant value jackpot. A master game comprises all game sets associated with a single constant value jackpot. The lottery game kit further comprises a prize board indicating the correspondence between ticket indicia and instant prizes. The game kit further includes a jackpot poster setting forth the jackpot and instructions for transmitting jackpot tickets to the jackpot sponsor. Each jackpot poster will include the final date for receipt of the name and address of a jackpot ticket purchaser and the winning ticket to the jackpot sponsor. The jackpot sponsor may, for example, be the manufacturer of the game sets. Thus, the jackpot sponsor provides the jackpot prize as an inducement to clubs or taverns to purchase game sets from the sponsor.

THE DRAWINGS

Further features and other objects and advantages of this invention will be made clear from the following detailed description made with reference to the drawings in which.

DESCRIPTION OF THE PREFERRED EMBODIMENTS

Figure 1:
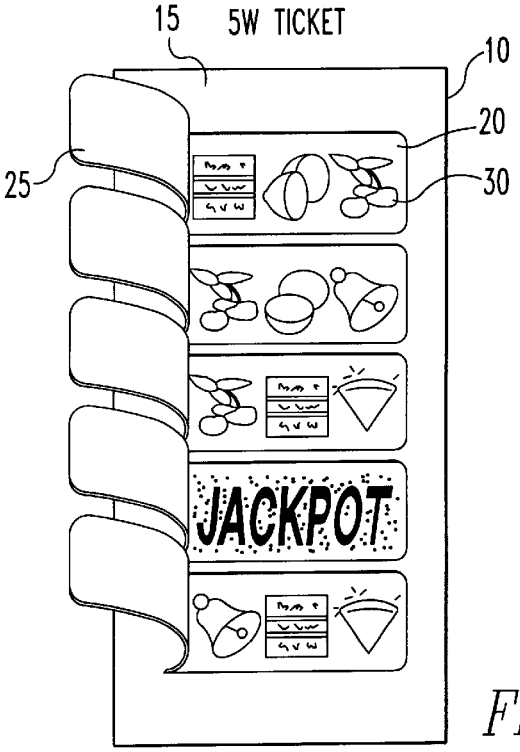
FIG. 1 is a five window ticket.
Figure 2:
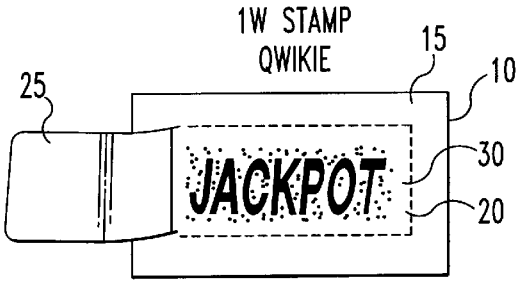
FIG. 2 is a one window ticket.
Figure 3:
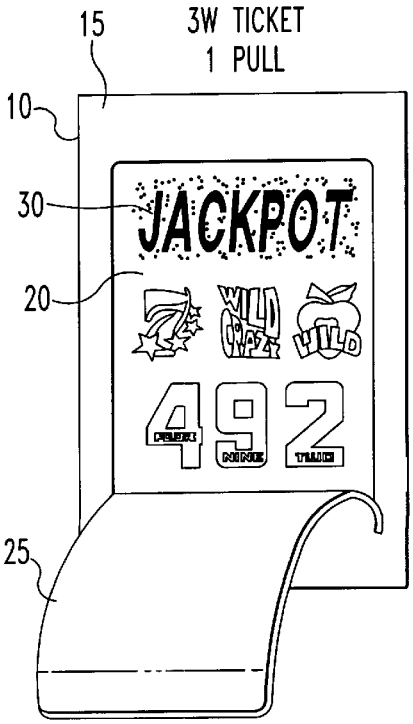
FIG. 3 is a three row pull ticket.
Figure 4:
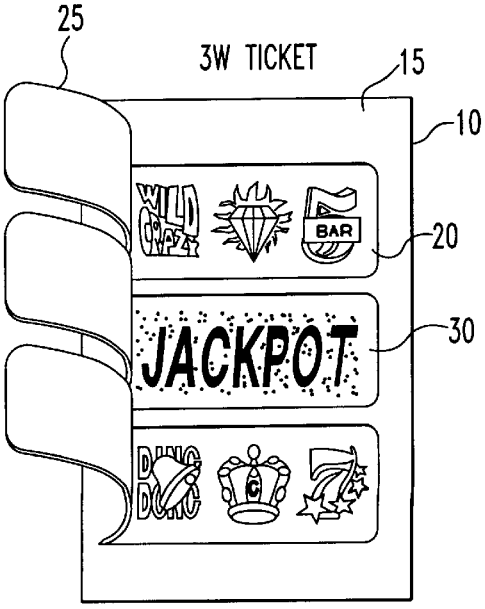
FIG. 4 is a three window ticket.
Figure 7:
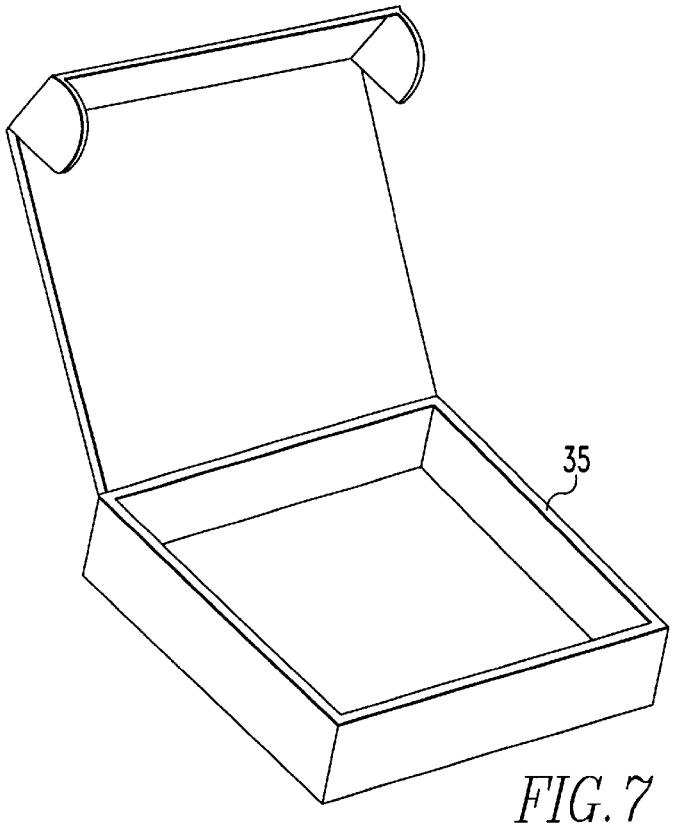
FIG. 7 is a representative container for a plurality of lottery tickets.
Figure 5:
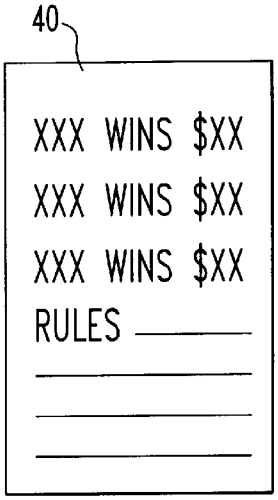
FIG. 5 is a prize board.
Figure 6:
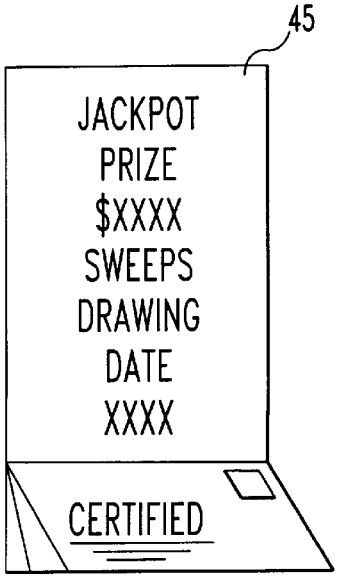
FIG. 6 is a jackpot poster.

Referring now to FIGS. 1 to 4, there are shown tickets 10 which include a laminated upper 15 and lower layer 20 of material such that until torn apart by removing a tab 25, the indicia 30 (symbols or numbers) hidden therein are not visible. Alternately, the ticket 10 may be folded and sealed such that until the seal is unbroken and the ticket 10 unfolded, the hidden indicia 30 are not visible. The particular tickets illustrated in FIGS. 1 to 4 are referred to in the industry as pull-tabs. Other types of tickets are suitable for use in game kits according to this invention. A plurality of lottery tickets may be packaged in a container 35 and a master game is comprised of lottery tickets from a plurality of containers.

The indicia 30 of the game set and master game on each sweepstakes eligible ticket enables an audit of the drawing to reduce the opportunity for fraudulent entries.

A prize board sets 40 forth the rules and the value of instant winning tickets. The prize board 40 displays a number of winners and the number of total tickets in each game set and any other information required by state laws.

A jackpot poster 45 announces and advertises the jackpot prize, the sweepstakes drawing date and may, for example, include instructions for transmitting jackpot tickets to the drawing location.

It should be understood that the jackpot is a ticket that could appear at any time and in any game. There could be one game or many different games being played at any one time. The size of the various games (ticket count) does not matter nor does the name of the game matter. A winning player could receive the jackpot prize either as an instant winner or be required to send the game piece back to the game sponsor for redemption depending on the size of the jackpot being offered. The jackpot could be cash or merchandise. Referring to FIGS. 1 to 4, the game pieces illustrated therein indicate the player is a jackpot winner. The jackpot has no bearing on how many tickets are sold nor does it increase in value as tickets are sold.

In an alternate embodiment, the game symbols, numbers or letters are covered by latex (scratch off) coatings to increase the excitement of playing the game.

Having thus described my invention with the detail and particularity required by the Patent Laws, what is desired protected by Letters Patent is set forth in the following claim.

What is claimed is:

1. A method of conducting a lottery game by a master game sponsor comprising the steps of:

a) producing a plurality of lottery ticket game sets making up one master game, said game sets comprising a plurality of lottery tickets with hidden indicia, said tickets having a tab that can be torn free to reveal the hidden indicia setting forth that some of the tickets entitle the purchaser to instant winnings and/or eligibility for a constant value jackpot associated with said master game;

b) selling game sets from a single master game by the master game sponsor to vendors who may in turn sell the individual lottery tickets from said game sets;

c) distributing a plurality of posters for explaining the game rules and for displaying the constant value jackpot prize and the last date for receipt of jackpot tickets entitling the purchaser to eligibility for a constant value jackpot for said master game;

d) receiving the jackpot tickets and randomly selecting a jackpot winner from those jackpot tickets and distributing the jackpot prize to the jackpot winner; and e) wherein the jackpot prize is paid out by the master game sponsor and wherein each instant winning is paid out by the vendor that sold the instant winning ticket.

2. The method according to claim 1, wherein multiple game ticket sets are distributed to unassociated vendors.

3. The method according to claim 1, wherein the price of the game sets includes the pro rata share of the jackpot prize.

4. A lottery kit comprising:

a plurality of containers;

a plurality of lottery tickets supplied within each container, said tickets when opened revealing hidden indicia, some of which entitle the lottery ticket purchaser to instant winnings and some of which will entitle the purchaser to eligibility for a constant value jackpot;

a poster for explaining the game rules; a prize board for displaying the constant value jackpot prize and the last date for tickets to be received by the jackpot sponsor; and wherein the lottery tickets in all of the containers are part of a master game for eligibility for the constant value jackpot and the lottery tickets in any one container are additionally part of an instant winning game.

5. The lottery game kit according to claim 4, wherein each ticket bears indicia of a particular game set and a master game.

* * * * *